US009470029B2

(12) United States Patent
Vos et al.

(10) Patent No.: US 9,470,029 B2
(45) Date of Patent: Oct. 18, 2016

(54) CASEMENT PIVOT ARM ROLLER HINGE

(71) Applicant: Pella Corporation, Pella, IA (US)

(72) Inventors: Jaden Vos, Pella, IA (US); Evan Vande Haar, Pella, IA (US); Andrew P. Schirz, Leighton, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 14/726,041

(22) Filed: May 29, 2015

(65) Prior Publication Data

US 2015/0345199 A1 Dec. 3, 2015

Related U.S. Application Data

(60) Provisional application No. 62/005,483, filed on May 30, 2014.

(51) Int. Cl.

| | |
|---|---|
| ***E05D 15/00*** | (2006.01) |
| ***E05D 15/30*** | (2006.01) |
| *E05F 11/34* | (2006.01) |

(52) U.S. Cl.

CPC ..... *E05D 15/30* (2013.01); *E05F 11/34* (2013.01); *E05Y 2201/688* (2013.01); *E05Y 2600/634* (2013.01); *E05Y 2800/696* (2013.01); *E05Y 2900/148* (2013.01); *Y10T 16/545* (2015.01); *Y10T 29/25* (2015.01)

(58) Field of Classification Search

CPC ..... Y10T 16/545; Y10T 16/5453; Y10T 16/5457; Y10T 16/547; Y10T 16/6298; Y10T 16/551; E05Y 2900/148; E05Y 2800/696; E05D 15/30; E05D 15/406; E05D 15/408; E05D 15/42; E05D 15/44; E05D 15/16; E05D 15/165; E05D 3/18; E05D 13/08; E05D 13/10; E05F 11/00; E05F 11/34

See application file for complete search history.

(56) References Cited

U.S. PATENT DOCUMENTS

| | | | | |
|---|---|---|---|---|
| 2,763,037 A * | 9/1956 | Benton | E05D 15/44 | 49/248 |
| 3,097,402 A * | 7/1963 | Ewing | E06B 3/50 | 16/93 R |
| 3,722,142 A * | 3/1973 | Anderberg | E05D 15/406 | 16/363 |
| 4,102,012 A * | 7/1978 | Davis | E05D 15/44 | 16/344 |
| 4,726,092 A * | 2/1988 | Tacheny | E05D 15/44 | 16/342 |
| 4,800,678 A * | 1/1989 | Loos | E05D 15/5217 | 16/360 |

(Continued)

*Primary Examiner* — Chuck Mah
(74) *Attorney, Agent, or Firm* — Faegre Baker Daniels LLP

(57) ABSTRACT

A casement window includes a lower hinge that has an oil-impregnated roller to facilitate easy opening and closing of the window, particularly with larger, heavier casement windows. In some instances, the lower hinge includes a housing having a roller portion and a guide portion. A roller can be disposed within the roller portion and a guide can be snap fitted into the guide portion. In some cases, a removable shipping spacer fits under the lower hinge and helps to support the weight of the sash during transport and storage.

20 Claims, 10 Drawing Sheets

(56) References Cited

U.S. PATENT DOCUMENTS 4,888,915 A * 12/1989 Goldenberg ..... E05D 15/0604 49/177
4,930,185 A * 6/1990 Hutton ..... E05D 15/44 16/325
5,040,267 A * 8/1991 Dallmann ..... E05D 15/30 16/235
5,452,543 A * 9/1995 VonWald ..... E05F 11/34 16/95 R
5,613,277 A 3/1997 Dallmann et al.
RE35,635 E 10/1997 Bauman
5,794,310 A 8/1998 Dallmann
5,927,014 A * 7/1999 Goldenberg ..... E05D 13/08 49/182
5,964,011 A * 10/1999 Ruston ..... E05D 7/0054 16/239
6,000,071 A 12/1999 Fettes
6,040,294 A 3/2000 Hausheer et al.
6,041,548 A 3/2000 Miller
6,112,371 A 9/2000 Tremblay
6,134,751 A 10/2000 Carrier et al.
6,374,544 B1 4/2002 Ellis
6,434,887 B2 8/2002 Nakanishi et al.
6,442,899 B1 * 9/2002 Gledhill ..... E05D 15/44 49/161
6,470,637 B2 10/2002 Gratz
6,536,077 B1 * 3/2003 Espey ..... E05D 15/165 16/106
6,643,896 B2 11/2003 Carrier
6,644,884 B2 * 11/2003 Gledhill ..... E05C 17/045 403/315
6,843,023 B2 1/2005 Liu
7,047,600 B2 5/2006 Muir
7,690,154 B2 4/2010 Muir
7,900,322 B2 3/2011 Doring et al.
7,900,400 B2 3/2011 Liang et al.
7,946,633 B2 5/2011 Minter
8,032,989 B2 10/2011 Liang et al.
8,418,404 B2 4/2013 Gramstad et al.
8,468,656 B2 6/2013 Bauman et al.
2001/0013202 A1 * 8/2001 Nakanishi ..... E05D 15/30 49/250
2002/0013978 A1 * 2/2002 Harkins ..... E05D 7/0054 16/239
2007/0289100 A1 * 12/2007 Lake ..... E05D 15/30 16/362
2011/0107678 A1 5/2011 Bauman et al.
2011/0131763 A1 * 6/2011 La See ..... E05D 15/30 16/364
2011/0203184 A1 * 8/2011 Nguyen ..... E05C 17/24 49/400
2012/0036781 A1 * 2/2012 Runk ..... E05C 17/24 49/181
2013/0198997 A1 * 8/2013 Olson ..... E05D 15/30 16/364

* cited by examiner

CASEMENT PIVOT ARM ROLLER HINGE

CROSS-REFERENCE TO RELATED APPLICATION

This application claims priority to U.S. Provisional Application Ser. No. 62/005,483, filed May 30, 2014 and entitled CASEMENT PIVOT ARM ROLLER HINGE, which is hereby incorporated by reference herein in its entirety.

BACKGROUND

There is a desire for ongoing improvements in fenestration hardware, such as hardware for casement windows.

SUMMARY

The disclosure pertains to a casement window including a lower hinge that has a roller to facilitate easy opening and closing of the window, particularly with larger, heavier casement windows. In some instances, the lower hinge includes a housing having a roller portion and a guide portion. A roller can be disposed within the roller portion and a guide can be snap fitted into the guide portion. In some cases, a removable shipping spacer fits under the lower hinge and helps to support the weight of the sash during transport and storage.

In one form thereof, the present disclosure provides a casement lower roller hinge including: a track securable to a lower portion of a window frame, the track including an engagement portion; a housing including a roller portion and a guide portion; a sash arm pivotably secured to the housing; a connecting arm pivotably secured to the sash arm and securable to the lower portion of the window frame; a roller secured within the roller portion of the housing via a pin extending through the roller, the roller positioned to roll along the track for repositioning of the sash arm; and a guide snapped into the guide portion of the housing, the guide slidably engaged with the engagement portion of the track.

In another form thereof, the present disclosure provides an assembly including: a window frame; a sash disposed within the window frame; a track including an engagement portion, the track secured to a lower portion of the window frame; a sash arm pivotably secured to the housing; a connecting arm pivotably secured to the sash arm and to the lower portion of the window frame; a housing pivotably secured to the sash arm, the housing including a roller portion and a guide portion; a roller secured within the roller portion of the housing via a pin extending through the roller, the roller positioned to roll along the track for all positions of the sash arm; and a guide snapped into the guide portion of the housing, the guide slidably engaged with the engagement portion of the track.

In yet another form thereof, the present disclosure provides a method of assembling a lower roller hinge, the method including: securing a track to a lower portion of a window frame, the track including an engagement portion; mounting a housing to the track, the step of mounting including: positioning a roller portion on the track, such that a roller secured to the roller portion can roll along the track; and engaging a guide portion with the track, such that a guide secured to the guide portion can slide along the engagement portion of the track; pivotably securing a sash arm to the housing; pivotably securing a first portion of a connecting arm to the sash arm; securing a second portion of the connecting arm to the lower portion of the window frame.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

FIG. 3*b* is an enlarged perspective view of a portion of FIG. 3*a;*

DETAILED DESCRIPTION

The disclosure pertains to fenestration units, particularly to fenestration units that pivot. This generally includes fenestration units that pivot about a vertical axis, such as a casement window, although applications in fenestration units that pivot about a horizontal axis are also contemplated. In some embodiments, as illustrated in FIG. 1, a fenestration unit can be a casement window.

Figure 1:
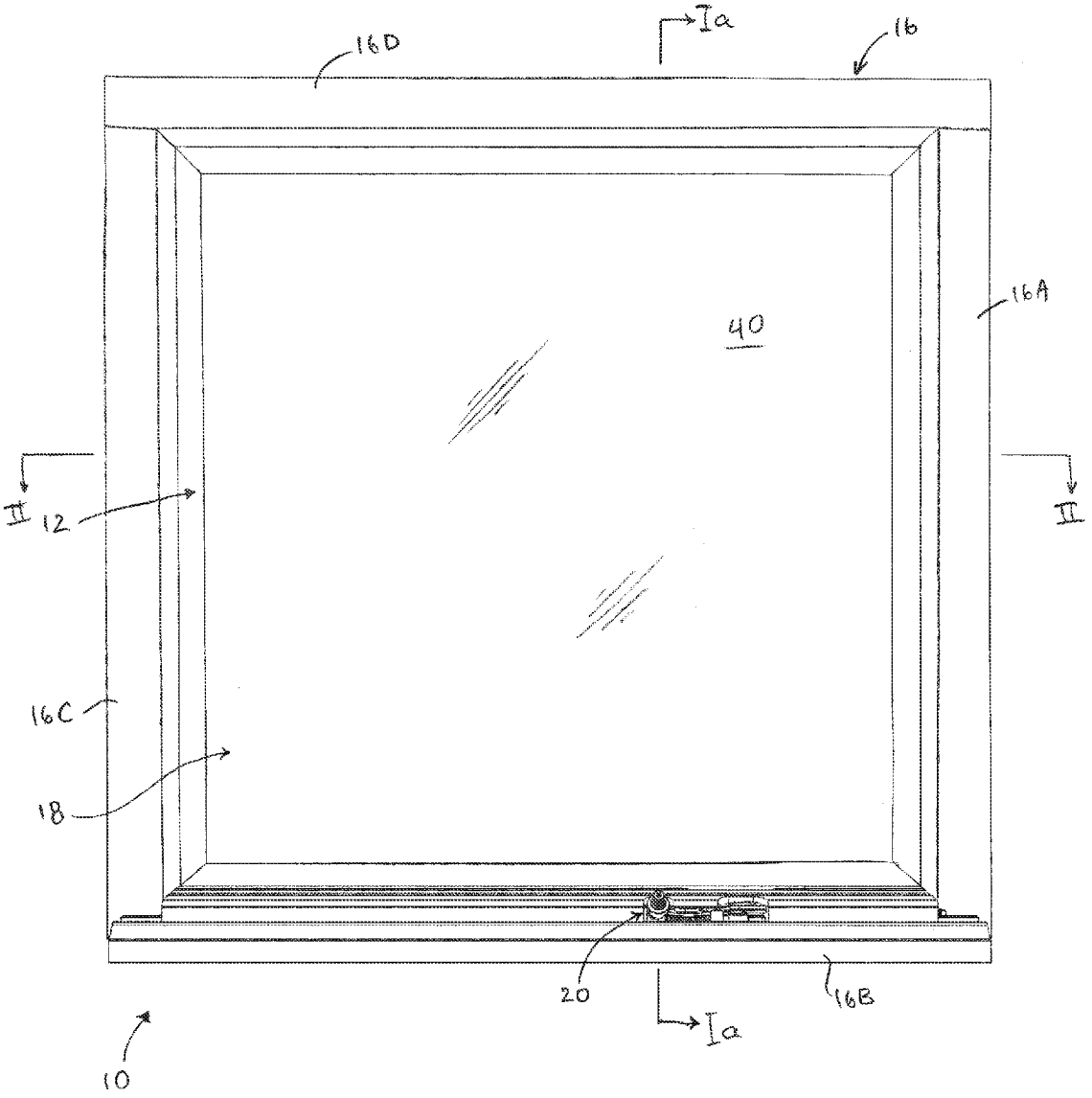
FIG. 1 is an inside elevation view of an embodiment of a window assembly in the closed configuration, according to an embodiments of the present disclosure.
Figure 1A:
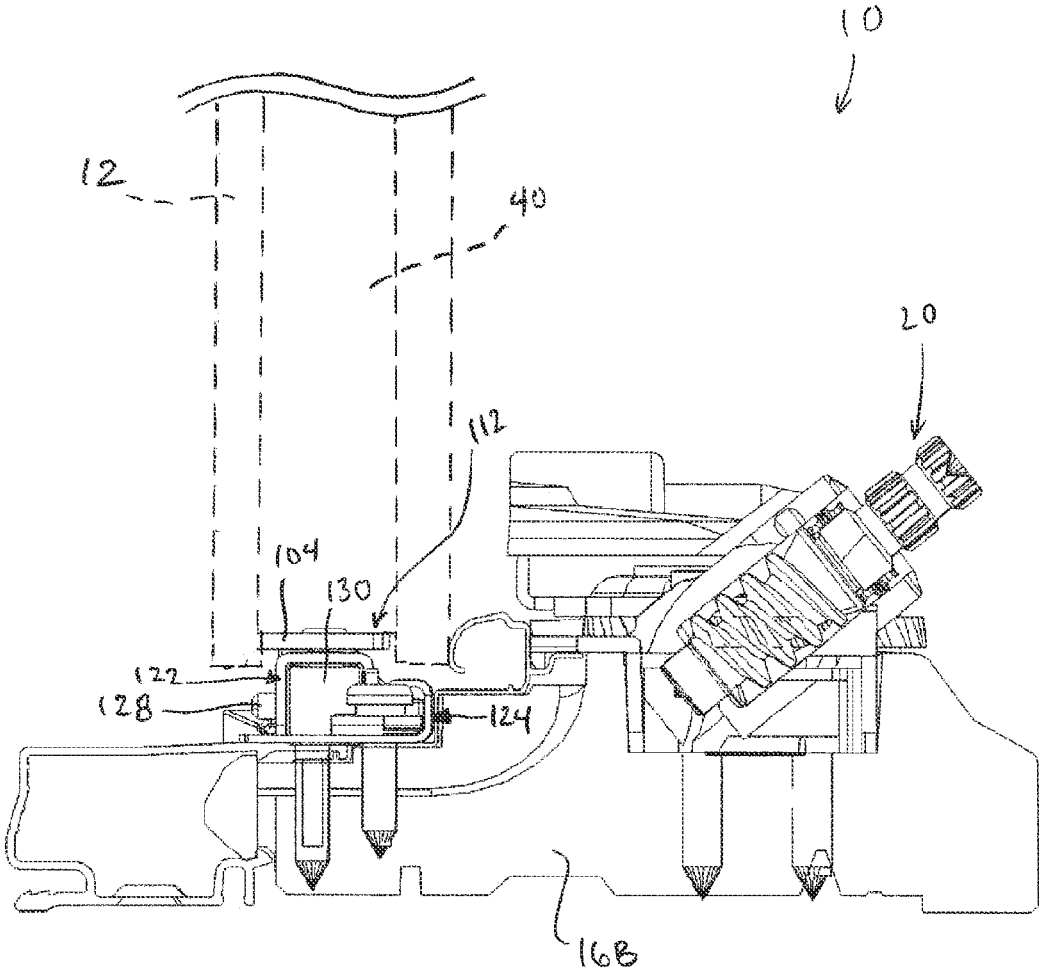
FIG. 1*a* is an elevation, cross-sectional view of the window assembly of FIG. 1 taken along line Ia-Ia of FIG. 1.

Referring now to FIGS. 1 and 1*a*, a schematic embodiment of a closure assembly 10 in accordance with the present invention can be seen as it would be viewed from inside a structure in which it is installed. The closure assembly 10 includes a window frame 16 adapted to be received in a rough opening created in a building structure (not shown). As used herein the phrase "window frame" refers to a framework mounted in a rough opening of a building structure for receiving and supporting one or more sashes of a window assembly. As used herein, the term "sash" refers to a framework for receiving and supporting one or more glazing panes. In double hung, awning, and casement windows, the sashes can be moved relative to the window frame. In a fixed window, the sash does not typically move relative to the window frame, but can be removed for repair purposes. Similar window assemblies may also be included in door assemblies. In a door, there can be a fixed or a moveable sash or multiple combinations of both. The moveable door sash can be moved laterally (sliding or rolling) or pivoting with side hinges. As used herein, the phrase "closure" refers to both a window and a door, although closure assembly 10 generally takes the form of a window.

The window frame 16 can be constructed of wood, vinyl, aluminum, or a variety of other materials. In the illustrated embodiment, the window frame 16 includes four peripheral frame members, 16A, 16B, 16C, and 16D, joined and secured together to form a rectangular shape corresponding to the shape of the rough opening. The inner perimeter of the rough opening is slightly larger than the perimeter of the window frame 16 of the closure assembly 10, so that the closure assembly 10 can be received in the rough opening during installation. The methods of mounting the window frame 16 to the rough opening are well known in the window industry. The window frame 16 defines a window opening 18. In the illustrated embodiment, the window opening 18 has a rectangular shape. Although the closure assembly 10 in the illustrated embodiment is rectangular, it is understood that the present invention is not limited by the shape of the closure assembly 10 as illustrated.

The closure assembly 10 also includes a sash 12 attached to the window frame 16 and received in the window opening 18 defined by the window frame 16. In some embodiments, the closure assembly 10 further includes an openable secondary sash (not shown) that is pivotally attached to the sash 12. In the illustrated embodiment, the sash 12 is operated in the same or a similar manner as a conventional casement window. In other words, the sash 12 is mounted to the sash arm 104, which hinged to the window frame 16 allowing the sash 12 to swing outwardly from the window frame 16 as best seen in FIG. 2 and further described below.

The sash 12 may be made of durable material, such as wood, vinyl, aluminum or variety of other materials. The methods of making window sashes are well known in the window manufacturing industry. The sash 12 includes a glazing unit 40 that is secured within the sash 12. The glazing unit 40 can include a single glass layer, two glass layers, or more. In some embodiments, the glazing unit 40 can include various coatings that impact visible and/or UV light transmission through the glazing unit 40.

A sash operator 20 for opening and closing the sash 12 uses a crank to actuate a linkage for pulling the sash 12 open and pushing it shut.

Figure 2:
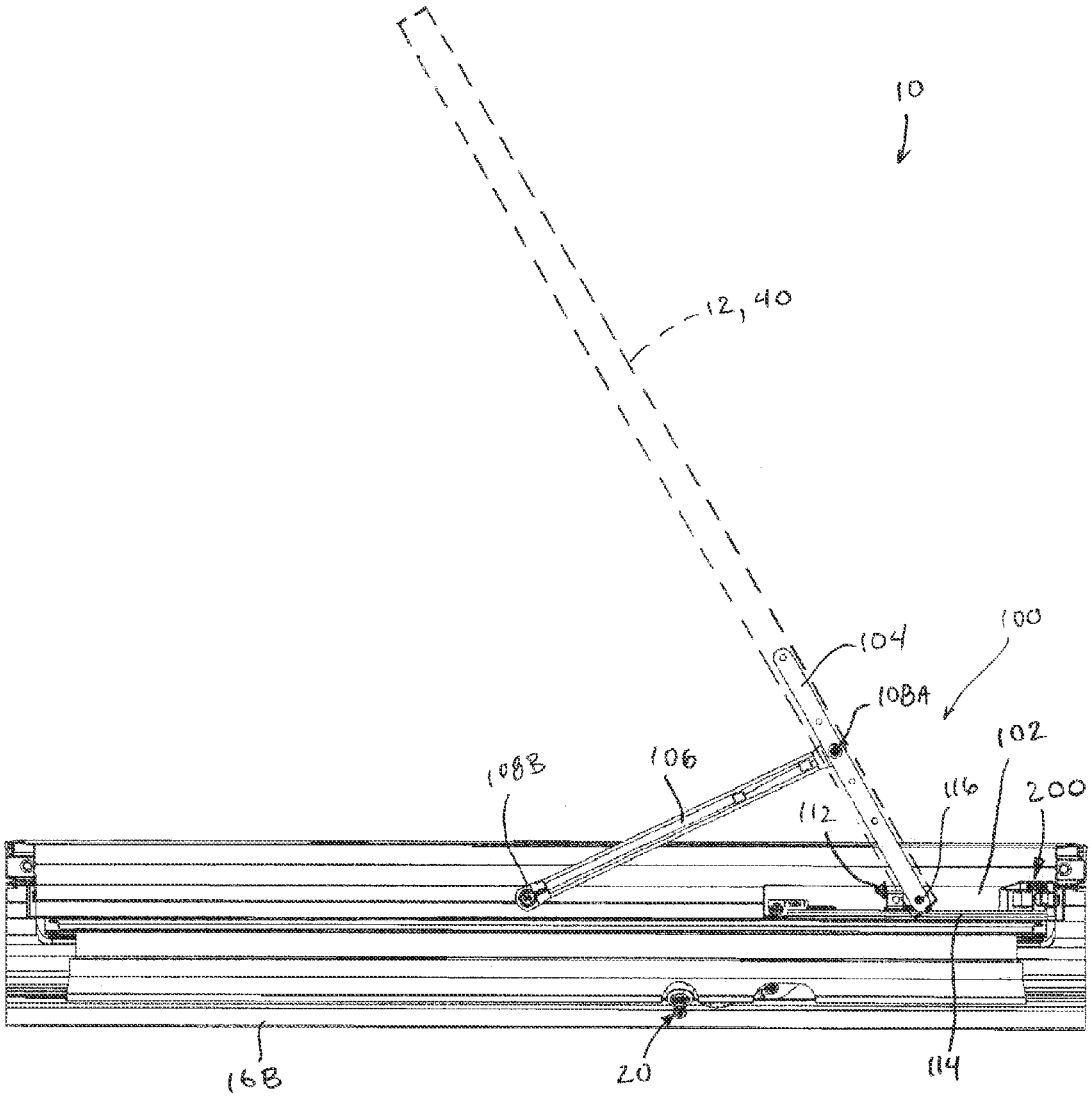
FIG. 2 is a top plan, cross-sectional view of the window assembly of FIG. 1, taken along line II-II of FIG. 1, shown with the window in an open configuration.

Although the views shown in FIGS. 1, 1A and 2 are generally schematic in nature, it is understood that various additional details and structures may be provided in accordance with standard practices in the window industry. For example, the closure assembly 10 may include a decorative wood trim mounted to the window frame 16 along the inner perimeter of the window frame 16. A retractable screen can optionally be included in the window closure 10, and a mechanism for operating the retractable screen can be attached, e.g., to the wood trim.

In addition, a latch mechanism for locking the frame of the glazing unit 40 to the frame 16 may be included in the window assembly 10. Suitable lock mechanisms are well known in the art as is shown in U.S. Pat. Nos. 4,059,298; 4,095,829; and/or 4,429,910, the entire disclosures of which are hereby incorporated by reference.

1.Oil-Impregnated Roller Assembly

FIGS. 2 through 10 illustrate various features of a lower pivoting roller hinge assembly 100 in accordance with some embodiments. As can be seen in FIG. 2, the lower hinge assembly 100 includes a track 102 that is configured to be secured to the lower portion 16B of the frame 16. While not expressly illustrated, the track 102 can include one or more openings that are sized and positioned to accommodate nails, screws, bolts or other suitable fasteners that can be used to secure the track 102 in place. The lower hinge assembly 100 includes a sash arm 104 that is pivotably connected to the lower portion 16B of the frame 16 at a pivot point 116. The sash arm 104 is also pivotably connected at a pivot point 108A to a first end of a connecting arm 106. The second, opposing end of connecting arm 106 is connected to the lower portion 16B of the frame 16 at pivot point 108B.

Figure 3:
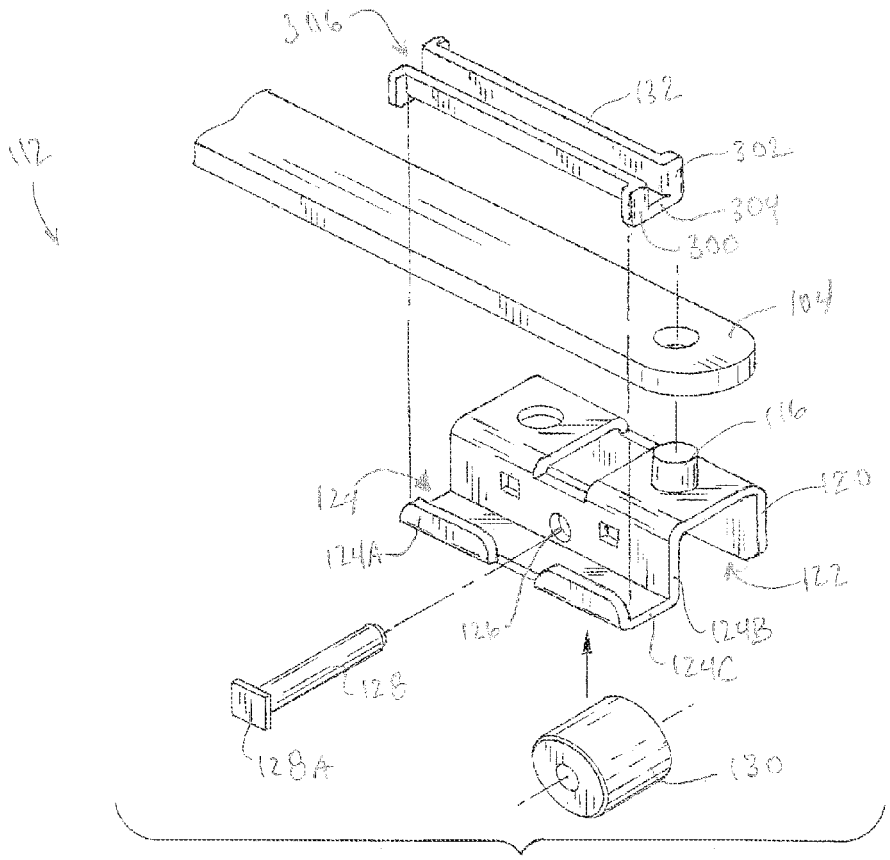
FIG. 3 is an exploded view of a portion of the casement pivot arm roller hinge of FIG. 2.
Figure 4:
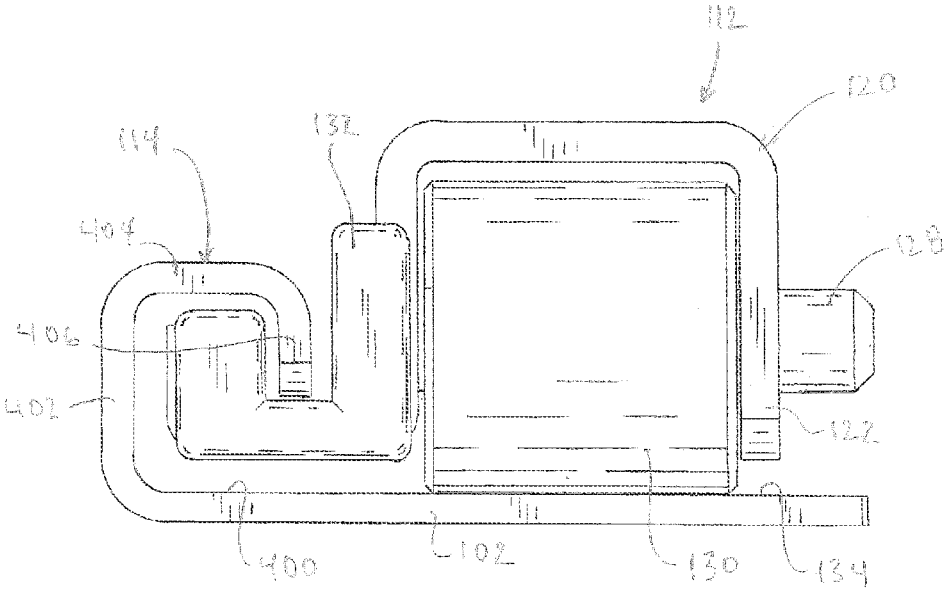
FIG. 4 is an end elevation view of a portion of the casement pivot arm roller hinge of FIG. 2, illustrating the roller hinge of FIG. 3.
Figure 3A:
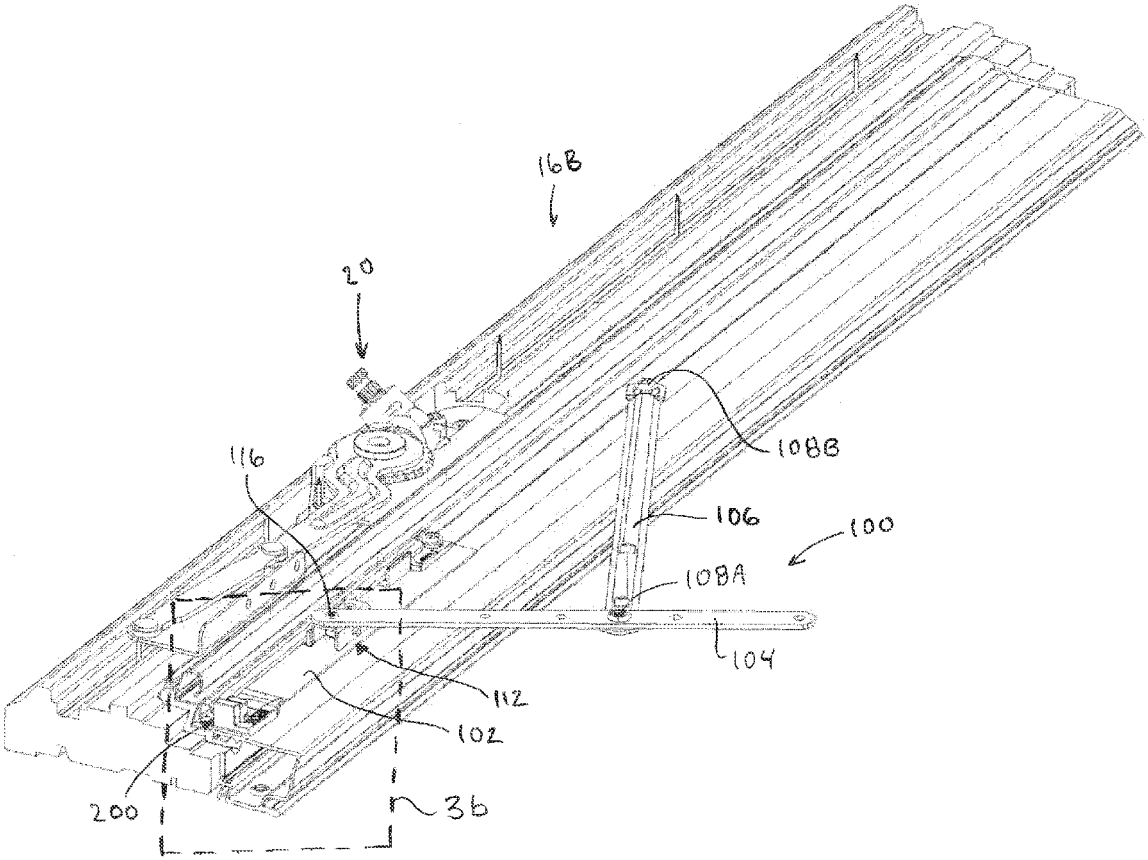
FIG. 3*a* is a perspective view of a portion of the window frame shown in FIG. 1, illustrating the pivot arm roller hinge of FIG. 3.
Figure 36:
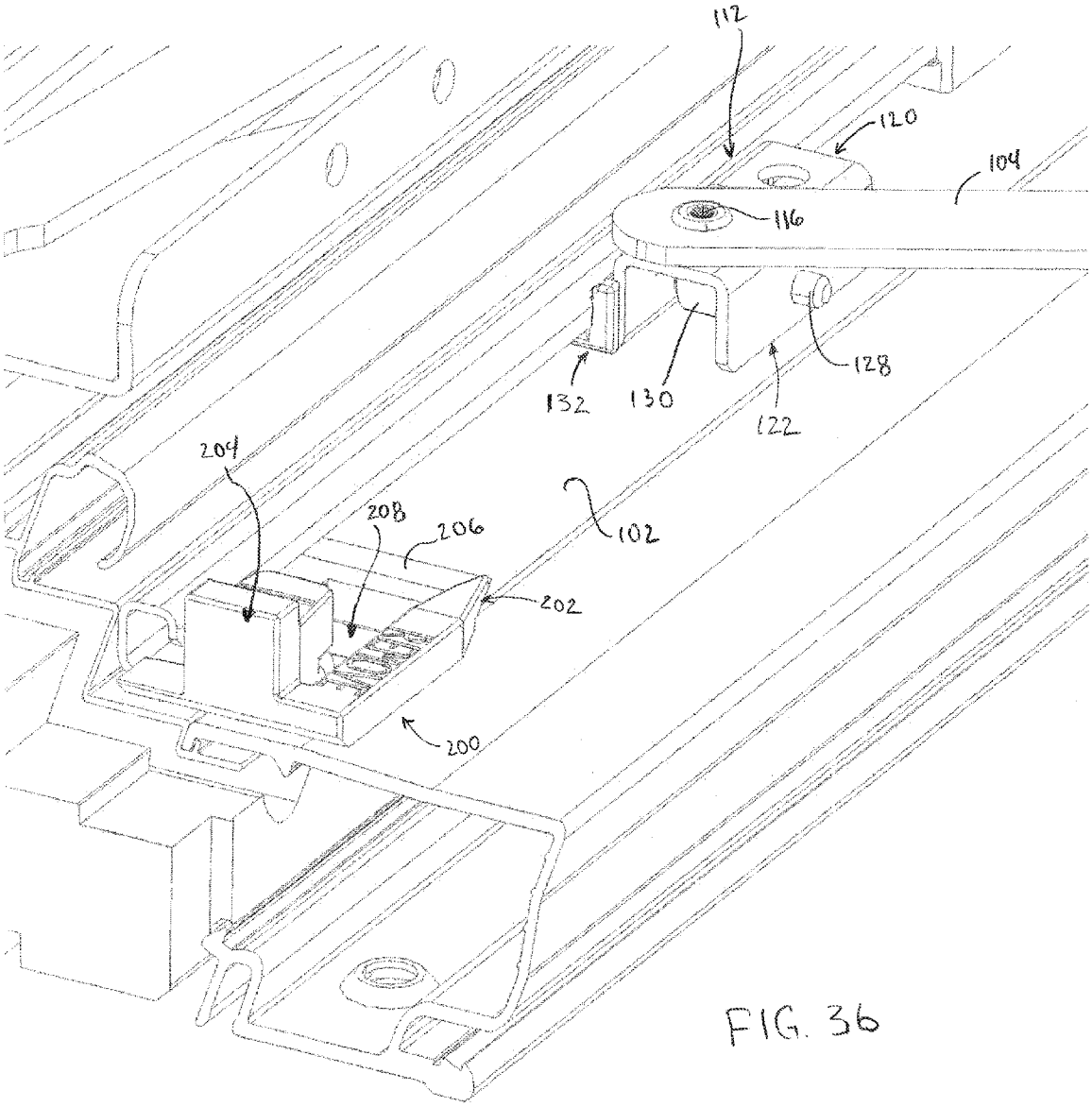

FIG. 3 provides an exploded view of the roller assembly 112, and FIGS. 3*a* and 3*b* provide an assembled view of roller assembly 112 mounted upon track 102. The assembly 112 includes a housing 120 that is secured to the sash arm 104 at the pivot point 116. As best seen in FIG. 3, the housing 120 includes a roller portion 122 and a guide portion 124. In some embodiments, the roller portion 122 includes an aperture 126 that is sized to accommodate a roller pin 128 optionally having a square head 128A, the roller pin 128 extending through a roller 130. In some embodiments, the guide portion 124 includes a first leg 124A, a second leg 124B and a bottom surface 124C extending therebetween in order to accommodate a guide 132, as will be discussed. As best shown in FIGS. 3*b* and 4, the roller pin 128 and roller 130 are secured within the roller portion 122 of the housing 120. The assembly 112 also includes a guide 132 that fits into the guide portion 124. As shown in subsequent drawings, the guide 132 slidingly interacts with the engagement portion 114 of the track 102.

The track 102 includes an engagement portion 114 that interacts with the guide 132. As seen for example in FIG. 4, the engagement portion 114 includes a lower surface 400, an outer wall 402, a top wall 404 and a lip 406. In some embodiments, as illustrated, the lip 406 engages the guide 132. The guide 132, as best illustrated in FIG. 3, is L-shaped or U-shaped in cross-section and includes a first leg 300, a second leg 302 and a base 304 extending between the first leg 300 and the second leg 302. The first and second legs 300, 302 and the base 304 define a track seat 306 for receiving the lip 406 of the engagement portion 114 of the track 102. There is no metal on metal contact between the track 102 and the housing 120. In some embodiments, as illustrated for example in FIGS. 4 and 10, the lip 406 fits into the track seat 306. A small clearance exists between the lip 406 and the track seat 306 to minimize friction while helping to guide the assembly 112 relative to the track 102.

As shown, the track seat 306 is substantially rectangular in shape and forms a complementary fit with the engagement portion 114 of the track 102 such that the lip 406 of the engagement portion 114 primarily engages the guide 132. In some embodiments, by helping ensure that the guide 132 primarily engages the lip of the engagement portion, the number of contact surfaces is controlled, and the friction between the track 102 and the guide 132 is able to be better controlled and thus reduced to a desired level. The guide 132 is made of one or more materials suited for repeated wear and/or reduced friction. In some embodiments, the guide 132 is formed of a polymeric material, such as acetal resin or nylon, for example, although a variety of materials are also contemplated. As shown, the guide 132 is spaced from the flat surface 134 of track 102 following assembly of the assembly 112.

Figure 5:
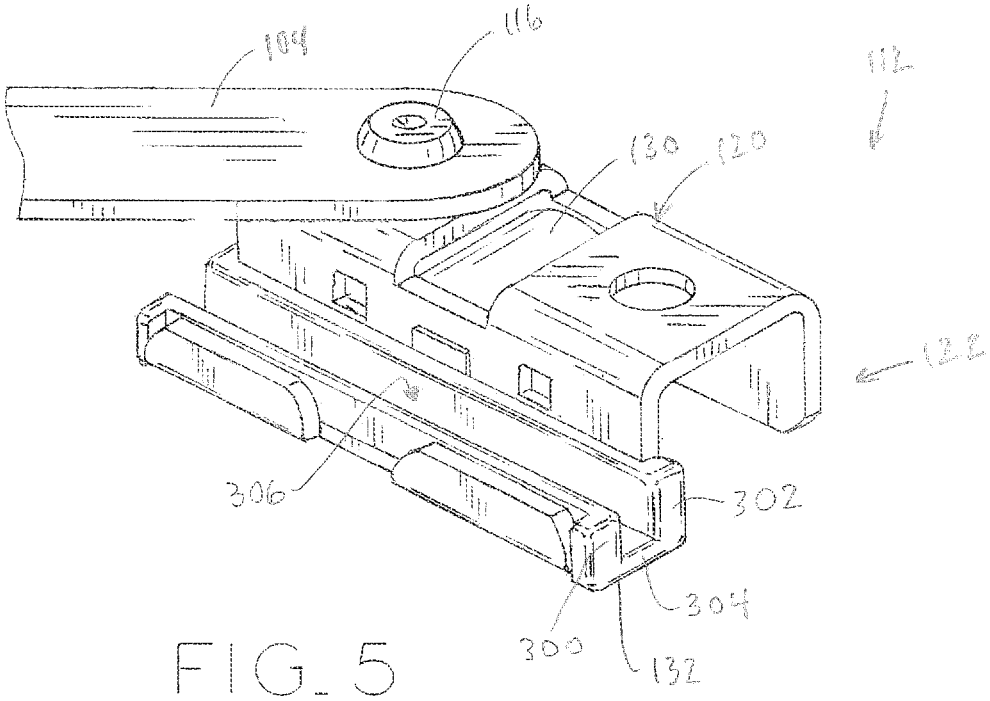
FIG. 5 is another perspective view of a portion of a casement pivot arm roller hinge.

FIGS. 4 and 5 provide illustrations of the assembly 112. As seen in FIG. 4, for example, the roller 130 rolls along a flat surface 134 of the track 102. The roller 130 is positioned to roll along the flat surface 134 of the track 102 for all positions of the sash arm 104. It will be appreciated that the roller 130 helps to support the weight of the sash 12 while also permitting easy movement of the sash 12. This can be helpful, particularly with larger and heavier sashes 12.

In some embodiments, the roller 130 is sintered and impregnated with oil, meaning that no lubrication is necessary. In some cases, each of the roller pin 128, the roller 130 and the housing 120 are formed of stainless steel such as 300 series stainless steel. The roller pin 128 optionally has a square head sized to physically interact with the adjacent bottom surface 124C upon assembly (FIG. 4), such that rotation of the roller pin 128 is prevented or restricted in use. In some embodiments, the guide 132 snaps into place within the guide portion 124 of the housing 120 and secures the roller pin 128 in place. It will be appreciated that each of the components forming the assembly 112 are un-handed, meaning that they can be assembled into either a right-handed assembly or a left-handled assembly, depending on which side the sash 12 pivotably opens.

In some embodiments, maintaining a snug clearance (e.g., about 0.003 inches) between the roller pin 128 and the roller 130 can help to keep debris out of the roller 130 and improve oil lubrication. In some embodiments, a snug fit (e.g., about 0.015 inches) between the axial end surfaces of roller 130 and the adjacent vertical walls of housing 120 can help keep debris off of the pin 128 and can assist in smooth and straight tracking of the roller 130 along surface 134 during operation of sash operator 20.

2. Shipping Spacer

Figure 6:
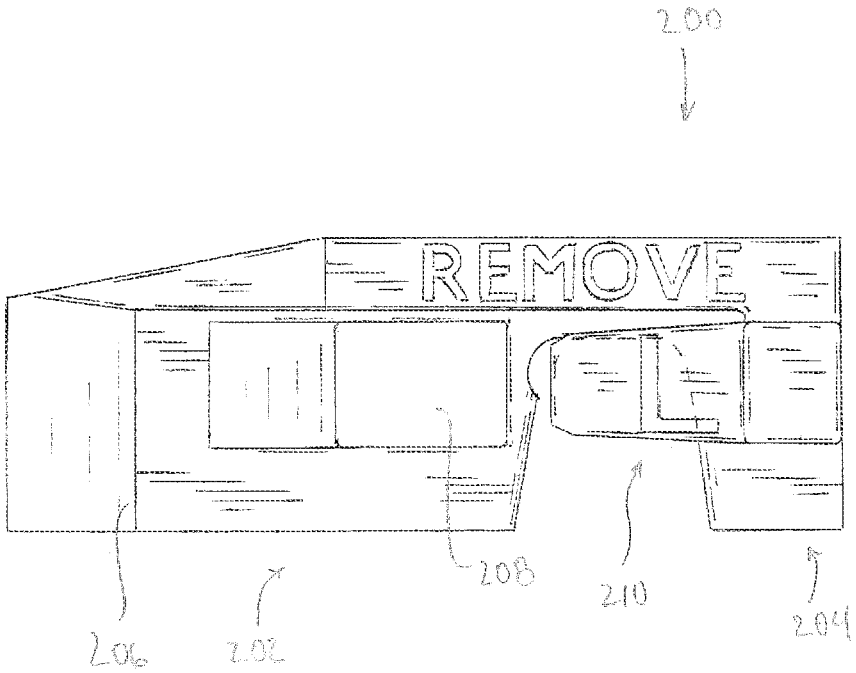
FIG. 6 is a top view of a removable shipping spacer, according to some embodiments.
Figure 6A:
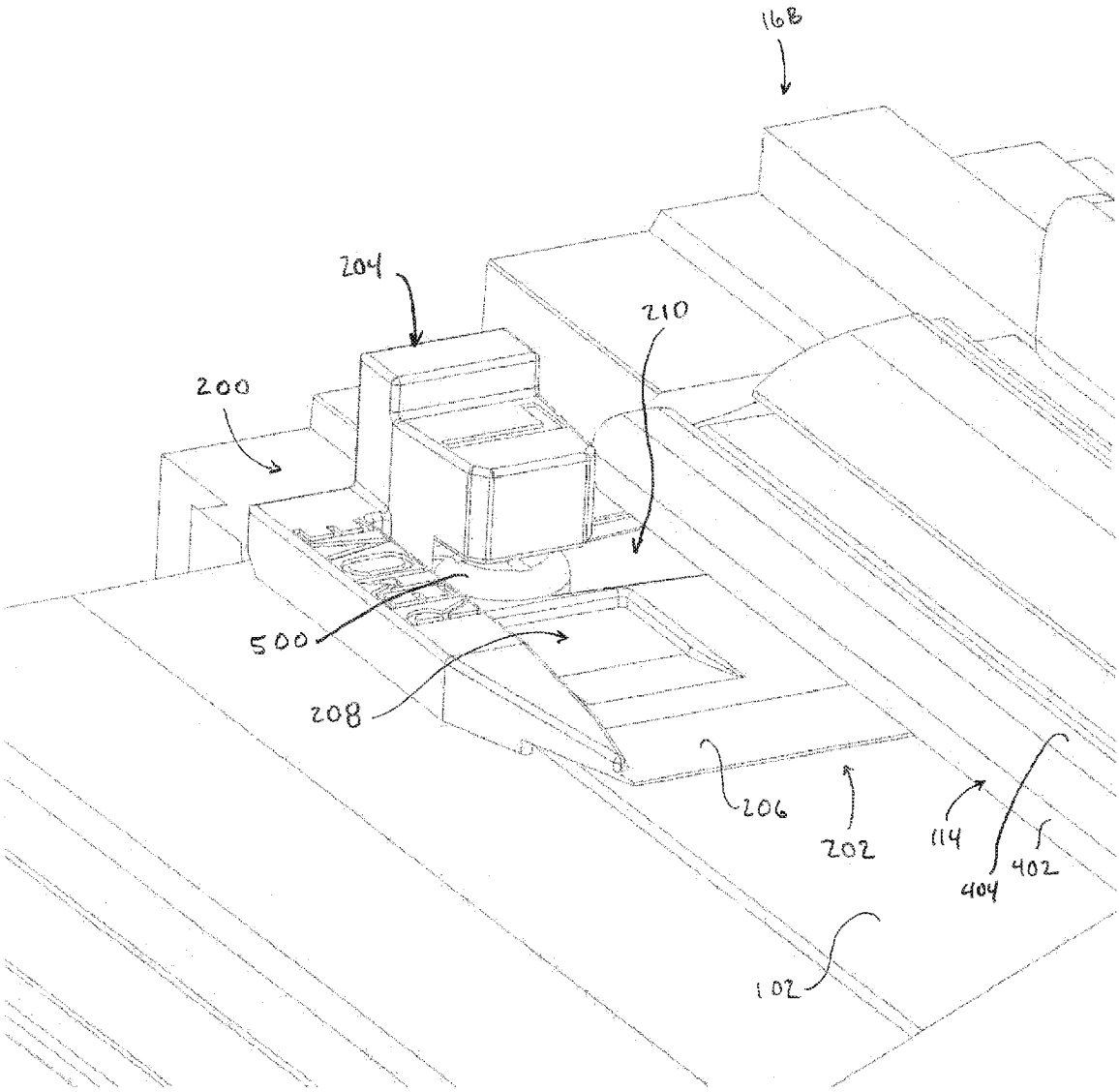
FIG. 6*a* is a perspective view of the spacer shown in FIG. 6, installed to the window frame shown in FIG. 3*a;*

FIGS. 6 and 6*a* provide an illustration of a removable shipping spacer 200 that can be used in combination with the lower hinge assembly 100 to help support at least part of the weight of the sash 12 and glazing unit 40 during transport and storage. In some cases, this can help prevent denting or other damage to the track 102, particularly if the casement window 10 is dropped or otherwise jolted during transport and/or storage. The removable shipping spacer 200 can also prevent deformation of the housing 120.

The removable shipping spacer 200 includes a beveled ramp portion 202 and a tower portion 204. The beveled ramp portion 202 is configured to accommodate the roller 130 and accordingly includes a low ramp 206 leading to a low spot or opening 208. The roller 130 can roll over the low ramp 206 to drop into and rest within the opening 208. The tower portion 204 is sized to extend upward and interact with the end of the sash arm 104 at pivot 116. Accordingly, at least a portion of the weight of the sash 12 and glazing unit 40 can pass through the pivot point 116 and the housing 120 of roller assembly 112 downward onto the lower portion 16B of the frame 16.

In some embodiments, the tower portion 204 is sized and configured to interact with a fastener 500, as seen in FIGS. 6*a* and 7-10. The fastener 500, which can be a screw or bolt, as desired, is one of a number of fasteners that secure the track 102 to the bottom 16B of the frame 16. As can be seen, especially in FIG. 10, the weight of the sash 12 can pass through the pivot point 116 and through a pivot point head 316 that rests on the tower portion 204 of the removable shipping spacer 200. In some embodiments, the roller 130 will go up the low ramp 206, lifting the housing 120. As the roller 130 goes down the low ramp 206 into opening 208, the hinge comes to rest upon the tower 204 (FIG. 9), thereby taking some or effectively all of the weight off of the roller 130 and transferring this weight to the frame 16 below. In an illustrative but non-limiting example, the fastener 500 can be a #8 pan head screw.

Figure 7:
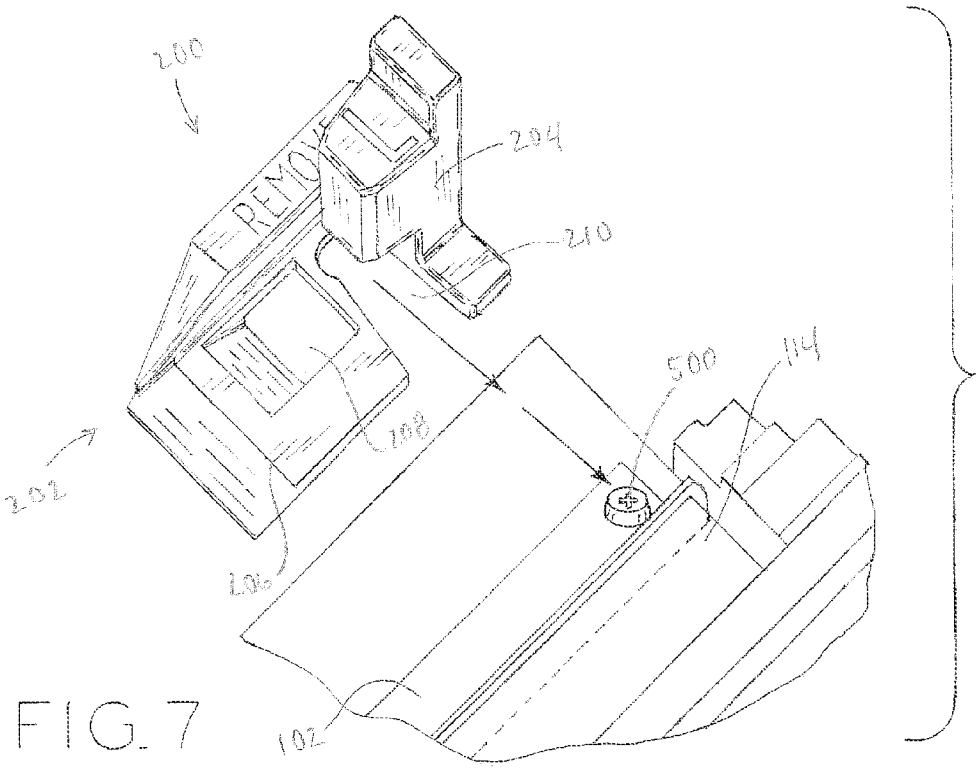
FIG. 7 is a view illustrating the removable shipping spacer of FIG. 6 prior to assembly with the window frame shown in FIG. 3*a;*
Figure 8:
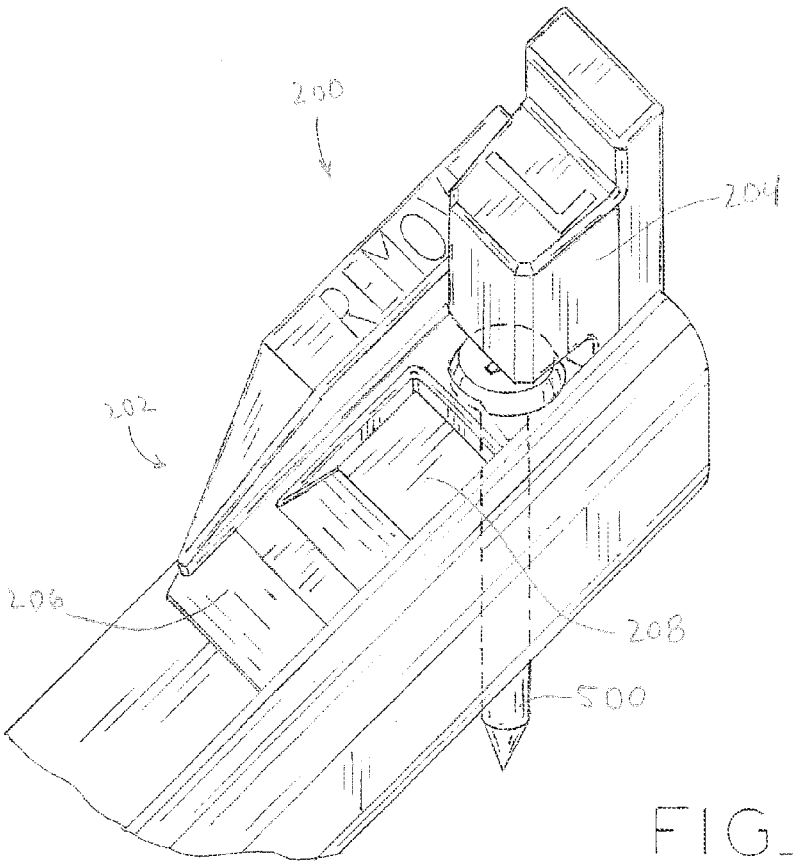
FIG. 8 is an enlarged perspective view of the removable shipping spacer of FIG. 6 after assembly to the window frame shown in FIG. 3*a;*
Figure 9:
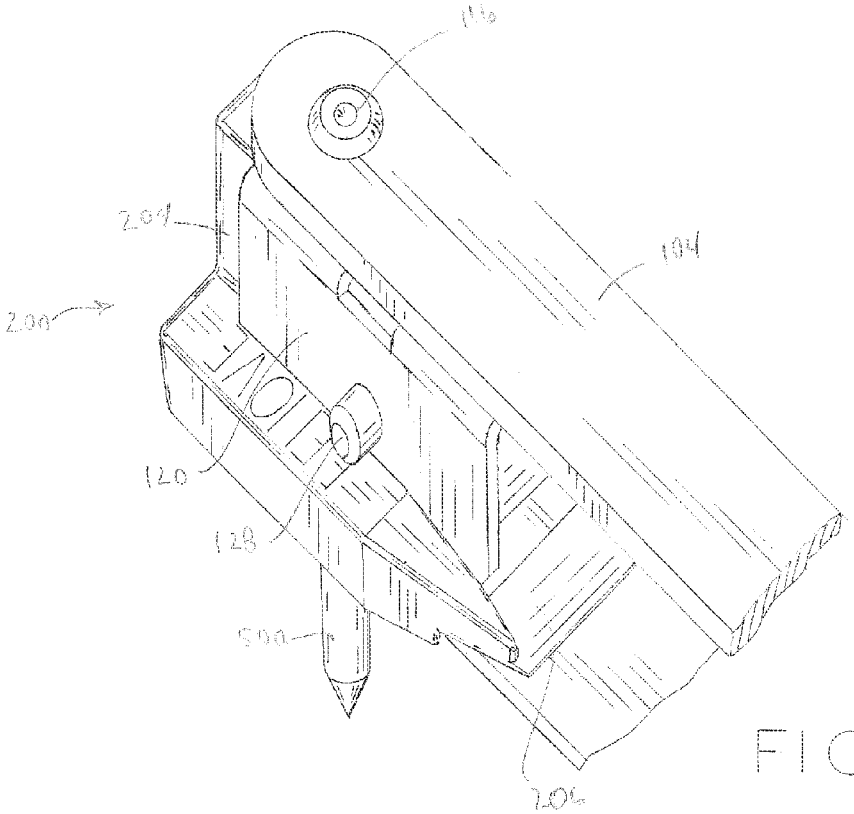
FIG. 9 is a perspective view of the removable shipping spacer of FIG. 6 engaged with a portion of the pivot arm roller hinge shown in FIGS. 3-3*b*.
Figure 10:
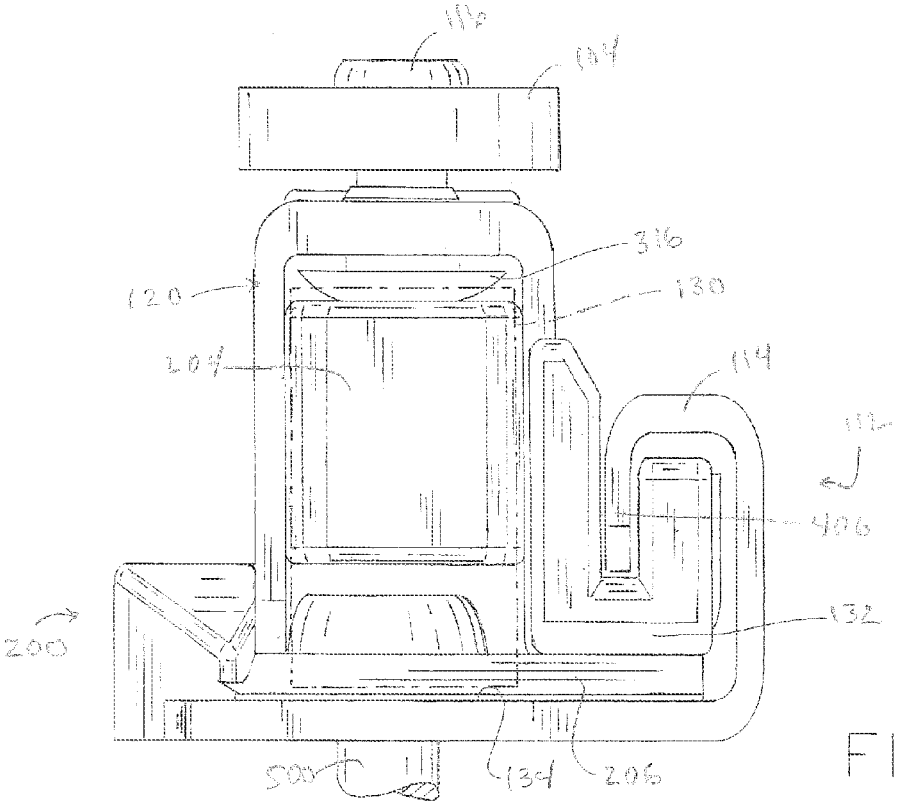
FIG. 10 is an end, elevation view of the removable shipping spacer of FIG. 6 engaged with a portion of the pivot arm roller hinge shown in FIGS. 3-3*b*.

In some embodiments, as illustrated, the removable shipping spacer 200 includes an aperture 210 that facilitates sliding the removable shipping spacer 200 into place over the fastener 500, as shown in FIGS. 6*a* and 7. Conversely, in such embodiments, the aperture 210 facilitates removal of the removable shipping spacer 200 from its position between the frame 16 and the sash by allowing spacer 200 to pass over fastener 500 without interference.

The removable shipping spacer 200 can be formed of any suitable material using any appropriate technique. In some embodiments, the removable shipping spacer 200 can be injection molded from a polymeric material. In some cases, the removable shipping spacer 200 can be formed from a polymeric material such as a polypropylene polymer or copolymer.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

We claim:

1. A casement lower roller hinge comprising:

a track securable to a lower portion of a window frame, the track including an engagement portion;

a housing including a roller portion and a guide portion;

a sash arm pivotably secured to the housing;

a connecting arm pivotably secured to the sash arm and securable to the lower portion of the window frame;

a roller secured within the roller portion of the housing via a pin extending through the roller, the roller positioned to roll along the track for repositioning of the sash arm; and a guide snapped into the guide portion of the housing, the guide slidably engaged with the engagement portion of the track.

2. The casement lower roller hinge of claim 1, wherein the roller is secured within the roller portion via a square-headed pin.

3. The casement lower roller hinge of claim 2, wherein the guide, once snapped into the guide portion, secures the square-headed pin in position.

4. The casement lower roller hinge of claim 1, wherein the roller comprises oil-impregnated stainless steel.

5. The casement lower roller hinge of claim 1, wherein the roller pin comprises stainless steel.

6. The casement lower roller hinge of claim 1, wherein the housing comprises stainless steel.

7. A removable shipping spacer configured for use with the casement lower roller hinge of claim 1, the removable shipping spacer comprising:

a beveled ramp portion including a low ramp configured to permit the roller to roll over and an opening configured to accommodate the roller in a resting position; and a tower portion configured to extend between a fastener in the track and a pivot point between the sash arm and the housing.

8. The removable shipping spacer of claim 7, wherein the spacer is made from a material including polypropylene.

9. An assembly comprising:

a window frame;

a sash disposed within the window frame;

a track including an engagement portion, the track secured to a lower portion of the window frame;

a housing including a roller portion and a guide portion:

a sash arm pivotably secured to the housing;

a connecting arm pivotably secured to the sash arm and to the lower portion of the window frame;

a roller secured within the roller portion of the housing via a pin extending through the roller, the roller positioned to roll along the track for all positions of the sash arm; and a guide snapped into the guide portion of the housing, the guide slidably engaged with the engagement portion of the track.

10. The assembly of claim 9, comprising a fastener securing the track to the lower portion of the window frame.

11. The assembly of claim 10, further comprising a removable shipping spacer including:

a beveled ramp portion including a low ramp configured to permit the roller to roll over and an opening configured to accommodate the roller in a resting position; and a tower portion configured to extend between the fastener in the track and a pivot point between the sash arm and the housing.

12. The assembly of claim 9, wherein the roller comprises an oil-impregnated roller.

13. A method of assembling a lower roller hinge, the method comprising:

securing a track to a lower portion of a window frame, the track including an engagement portion;

mounting a housing to the track, the step of mounting including:

positioning a roller portion of the housing on the track, such that a roller secured to the roller portion can roll along the track; and engaging a guide portion of the housing with the track, such that a guide secured to the guide portion can slide along the engagement portion of the track;

pivotably securing a sash arm to the housing;

pivotably securing a first portion of a connecting arm to the sash arm;

securing a second portion of the connecting arm to the lower portion of the window frame.

14. The method of claim 13, further comprising:

rotatably securing the roller within the roller portion of the housing; and snapping the guide into the guide portion of the housing.

15. The method of claim 14, wherein the step of securing the roller within the roller portion comprises inserting a square-headed pin through the roller portion and the roller.

16. The method of claim 15, further comprising securing the square-headed pin in position by the step of snapping the guide into the guide portion.

17. The method of claim 13, further comprising attaching a removable shipping spacer to the track, the removable shipping spacer having a beveled ramp portion configured to permit the roller to roll over and a tower portion configured to extend between a fastener in the track and a pivot point between the sash arm and the housing.

18. The method of claim 17, further comprising rolling the roller over the ramp and into an opening of the ramp portion, such that the opening accommodates the roller in a resting position.

19. The method of claim 18, wherein the step of rolling the roller over the ramp further comprises resting the sash arm on the tower portion.

20. The method of claim 19, further comprising securing the track to the lower portion of the window frame with a fastener before the step of attaching a removable shipping spacer to the track, the fastener sized to be received under the tower portion such that the fastener supports the sash arm via the removable shipping spacer.

* * * * *